US008876984B2

(12) United States Patent
Hong et al.

(10) Patent No.: US 8,876,984 B2
(45) Date of Patent: Nov. 4, 2014

(54) DISH WASHING MACHINE

(71) Applicant: Samsung Electronics Co., Ltd, Suwon-si (KR)

(72) Inventors: Seung Gee Hong, Suwon-si (KR); Yong Soo Kyong, Seoul (KR); Chan Young Park, Suwon-si (KR); Jea Won Lee, Hwaseong-si (KR); Chang Wook Lee, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/910,521

(22) Filed: Jun. 5, 2013

(65) Prior Publication Data

US 2013/0319487 A1 Dec. 5, 2013

(30) Foreign Application Priority Data

Jun. 5, 2012 (KR) ..... 10-2012-0060656

(51) Int. Cl.

| | |
|---|---|
| ***B08B 3/00*** | (2006.01) |
| ***A47L 15/42*** | (2006.01) |
| ***A47L 15/06*** | (2006.01) |
| ***A47L 15/18*** | (2006.01) |

(52) U.S. Cl.

CPC ..... *A47L 15/06* (2013.01); *A47L 15/4278* (2013.01); *A47L 15/18* (2013.01)

USPC ..... 134/56 D; 134/57 D

(58) Field of Classification Search

None

See application file for complete search history.

(56) References Cited

U.S. PATENT DOCUMENTS

| | | | | |
|---|---|---|---|---|
| 7,935,194 | B2 * | 5/2011 | Rolek | 134/56 D |
| 7,959,744 | B2 * | 6/2011 | Sundaram et al. | 134/56 D |
| 7,988,791 | B2 | 8/2011 | Delgado | |
| 2003/0183255 | A1 | 10/2003 | Kim et al. | |
| 2009/0056754 | A1 * | 3/2009 | Rolek | 134/18 |
| 2009/0071508 | A1 * | 3/2009 | Sundaram et al. | 134/18 |

FOREIGN PATENT DOCUMENTS

| | | |
|---|---|---|
| DE | 564 907 | 11/1932 |
| DE | 1 191 527 | 1/1962 |
| EP | 2 039 280 | 9/2008 |

(Continued)

OTHER PUBLICATIONS

European Search Report issued Oct. 10, 2013 in corresponding European Application No. 13 17 0691.

(Continued)

*Primary Examiner* — Jason Ko

(74) *Attorney, Agent, or Firm* — Staas & Halsey LLP

(57) ABSTRACT

A dish washing machine having a structure allowing water to be evenly ejected onto the interior of a washing tub. The dish washing machine includes a cabinet forming an external appearance of the dish washing machine, a washing tub arranged in the cabinet and allowing dishes to be washed therein, a dish basket arranged in the washing tub, at least one liquid ejection unit arranged in the washing tub to eject water, a defection unit arranged facing the liquid ejection unit to deflect the water ejected from the liquid ejection unit toward the dish basket, and a drive unit to drive the defection unit to be moved within the washing tub. Since the dish washing machine includes a defection unit in addition to a liquid ejection unit, a dead zone which water does not reach may be eliminated and divided and intensive washing may be possible in the washing tub.

20 Claims, 8 Drawing Sheets

(56) References Cited

FOREIGN PATENT DOCUMENTS

| | | |
|---|---|---|
| JP | 7-116102 | 5/1995 |
| JP | 7-163505 | 6/1995 |
| JP | 10-127552 | 5/1998 |
| JP | 2008-279137 | 11/2008 |
| KR | 10-2006-0128399 | 12/2006 |
| KR | 10-2007-0078128 | 7/2007 |
| SE | 577 302 | 5/1976 |
| WO | WO 92/12665 | 8/1992 |
| WO | WO 2011/144540 | 11/2011 |

OTHER PUBLICATIONS

International Search Report issued Sep. 17, 2013 in corresponding Patent Application No. PCT/KR2013/004894.

* cited by examiner

DISH WASHING MACHINE

CROSS-REFERENCE TO RELATED APPLICATIONS

This application claims the benefit of Korean Patent Application No. 10-2012-0060656, filed on Jun. 5, 2012 in the Korean Intellectual Property Office, the disclosure of which is incorporated herein by reference.

BACKGROUND

1. Field

Embodiments of the present disclosure relate to a dish washing machine having a structure allowing water to be evenly ejected onto the interior of a washing tub.

2. Description of the Related Art

A dish washing machine, which generally washes dishes by ejecting high-pressure water onto dishes, usually performs operations of preliminary washing, main washing, rinsing, and drying. In the preliminary washing, water having no detergent introduced thereinto is ejected to remove debris from the dishes. In main washing, the dishes are cleaned with detergent introduced into the ejected water by a detergent feeder.

The dish washing machine generally includes a cabinet provided therein with a washing tub, a dish basket adapted to retain dishes and installed in the washing tub to be movable forward and backward, and a liquid ejection unit to eject water onto the dish basket. The dishes are washed by the water ejected by the liquid ejection unit.

The dish basket includes an upper dish basket arranged at an upper portion of the washing tub, and a lower dish basket arranged at a lower portion of the washing tub.

In conventional cases, liquid ejection units are positioned at the upper side of the upper dish basket, and at the upper and lower sides of the lower dish basket. In the case that the liquid ejection units are rotatably arranged, there may be dead zones at the corners of the rectangular washing tub which the ejected water does not reach.

A liquid ejection unit having a variable length or having a rotatable structure has been proposed to eliminate dead zones which the water does not reach. This eject nozzle may eliminate the dead zones, but may not obtain the effect of divided or intensive washing.

In addition, in the case of a structure of the liquid ejection unit allowing the water to reach the dead zones by changing the direction in which the liquid ejection unit extends, when the direction of the liquid ejection unit is perpendicular to the wall of the washing tub, the water is directed to the wall of the washing tub, and thereby the liquid ejection unit may fail to wash the dishes, and further noise from the liquid ejection unit may increase.

Moreover, in the case that the liquid ejection unit is fixed to the dish basket, flow channels may be inefficiently disposed and complicate the structure of the dish basket.

SUMMARY

Therefore, it is an aspect of the present disclosure to provide a dish washing machine which may eliminate dead zones which the water does reach by including a liquid ejection unit to eject water toward the dish basket and a deflection unit adapted to deflect the water.

Additional aspects of the disclosure will be set forth in part in the description which follows and, in part, will be apparent from the description, or may be learned from practice of the disclosure.

In accordance with one aspect of the present disclosure, a dish washing machine includes a cabinet forming an external appearance of the dish washing machine, a washing tub arranged in the cabinet and allowing dishes to be washed therein, a dish basket arranged in the washing tub to accommodate the dishes, at least one liquid ejection unit arranged in the washing tub to eject water onto the dish basket, a deflection unit arranged facing the liquid ejection unit to deflect the water ejected from the liquid ejection unit, and a drive unit to drive the deflection unit to be movable within the washing tub.

The liquid ejection unit may include a body extending in a first direction and a plurality of liquid ejecting heads provided on the body, and the drive unit may be operable to move the deflection unit forward and backward in a second direction perpendicular to the first direction while water is being ejected by the liquid ejection unit.

The deflection unit may be disposed at at least one of upper and lower sides of the dish basket to deflect the water ejected from the liquid ejection unit toward the dish basket.

The deflection unit may include a concave portion having a surface to contact the water ejected from the liquid ejection unit, the surface being concavely formed to deflect the water toward the dish basket.

The concave portion may be formed in a shape of a curved surface to deflect the water.

The concave portion may include at least one bent portion bent along a longitudinal direction of the deflection unit to deflect the water in various directions.

A plurality of grooves may be provided at an inner side of the concave portion to guide deflection of the water.

The grooves may be formed only at a portion of the concave portion to guide deflection of the water toward the dishes.

The drive unit may include a rail coupled to the deflection unit to guide movement of the deflection unit, and a power generating unit to drive the deflection unit.

The drive unit may further include a pulley or a gear coupled to the power generating unit, and the drive unit and the deflection unit are connected to each other through a connection member.

The rail may be arranged at opposite walls facing each other in the washing tub to guide the movement of the deflection unit.

The liquid ejection unit may be arranged at a rear surface of the washing tub.

In accordance with another aspect of the present disclosure, a dish washing machine including a washing tub to wash dishes and a dish basket arranged in the washing tub to accommodate the dishes, includes a liquid ejection unit positioned at a lower side of the dish basket and adapted to eject water in a first direction, and a deflection unit to deflect the water from the liquid ejection unit in a second direction toward the dishes.

The deflection unit may include a concave portion concavely formed to deflect the water from the first direction to the second direction.

The dish washing machine may further include a drive unit to drive the deflection unit to move between front and rear surfaces of the washing tub or between left and right surfaces of the washing tub.

The drive unit may include a rail coupled to the deflection unit to guide movement of the deflection unit, a motor to drive the deflection unit, a pulley or gear coupled to the motor, and a connection member to connect the pulley or gear to the defection unit.

The deflection unit may be moved toward the liquid ejection unit by the connection member and may be moved away from the liquid ejection unit by a pressure of the water ejected from the liquid ejection unit.

In accordance with another aspect of the present disclosure, a dish washing machine includes a cabinet forming an external appearance of the dish washing machine, a washing tub arranged in the cabinet and allowing dishes to be washed therein, a liquid ejection unit positioned at at least one surface of the washing tub and adapted to eject water in a direction substantially parallel with the dish basket, a deflection unit provided with a concave portion at a surface thereof to contact the water ejected from the liquid ejection unit to deflect the water to a direction substantially perpendicular to a direction in which the water is ejected from the liquid ejection unit, and a drive unit including a rail coupled to the deflection unit to allow the deflection unit to move toward or away from the liquid ejection unit, and a motor to move the deflection unit, wherein at least one of a state in which the deflection unit is moved toward the liquid ejection unit and a state in which the deflection unit is moved away from the liquid ejection unit is achieved by the motor of the drive unit.

The drive unit may further include a pulley coupled to the motor, and a connection member to connect the pulley to the deflection unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
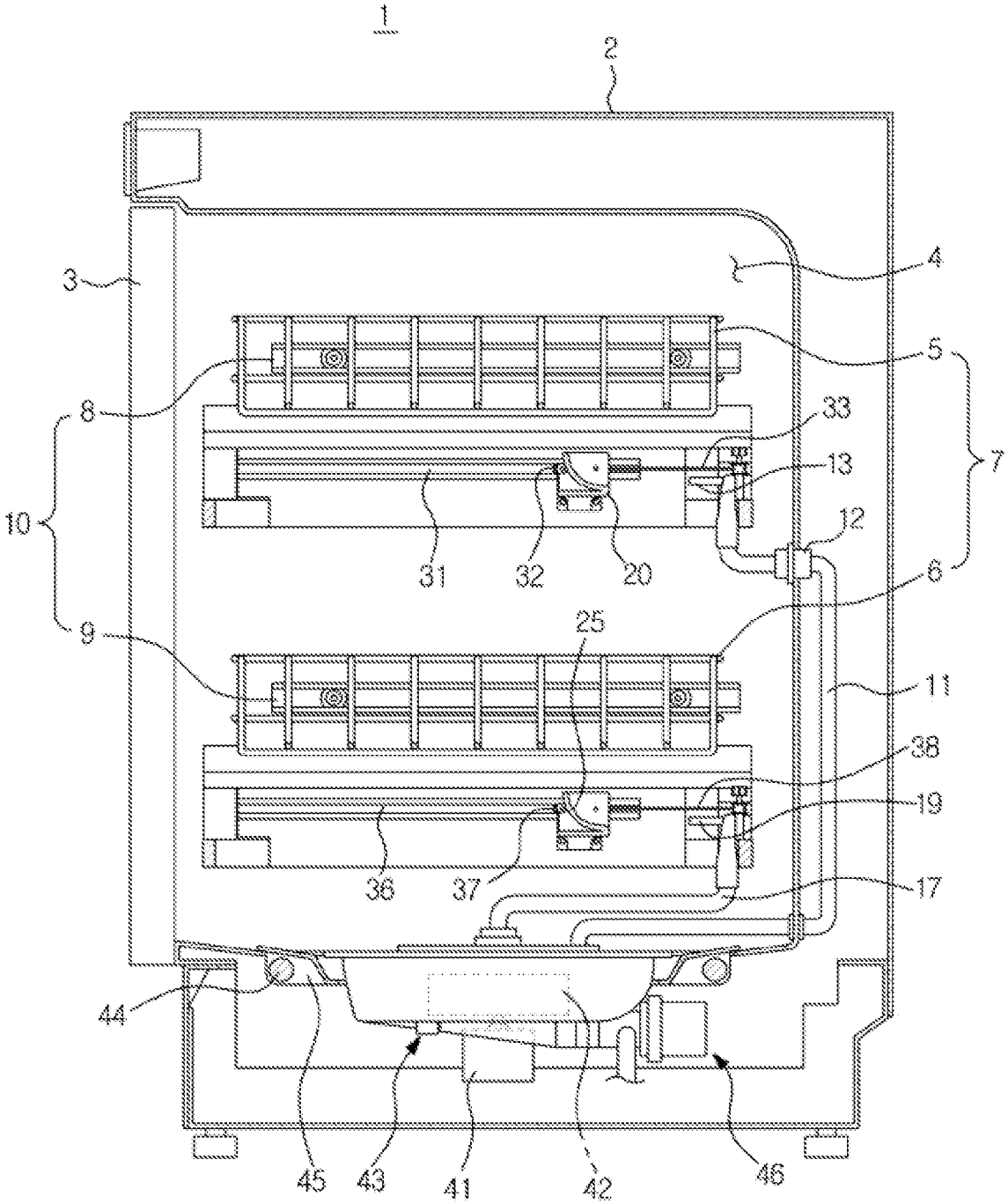
FIG. 1 is a cross-sectional view illustrating the configuration of a dish washing machine according to an exemplary embodiment of the present disclosure.

Reference will now be made in detail to the embodiments of the present disclosure, examples of which are illustrated in the accompanying drawings, wherein like reference numerals refer to like elements throughout.

FIG. 1 is a cross-sectional view illustrating the configuration of a dish washing machine according to an exemplary embodiment of the present disclosure.

As shown in FIG. 1, the dish washing machine 1 includes a cabinet 2 forming an external appearance of the dish washing machine 1, and a washing tub 4 arranged in the cabinet 2 to wash dishes. A sump 43 allowing water to be stored therein is provided at the lower portion of the washing tub 4.

The front of the cabinet 2 is open to allow dishes to be placed in or withdrawn from the washing tub 4. A door 3 is installed at the front of the cabinet 2 to open and close the washing tub 4. The door 3 is hinged to the front lower portion of the cabinet 2 to open and close the washing tub 4 by rotation.

A pair of dish baskets 7 provided with a receipt part having an open upper side to receive dishes is installed at the upper and lower portions of the inside of the washing tub 4 such that the dish baskets 7 are movable forward and backward. The dish baskets 7 are allowed to be placed in or withdrawn from the cabinet 2 through the open front of the cabinet 2 by at least one rack 10 slidably supporting the dish baskets 7. The rack 10 may include an upper rack 8 and a lower rack 9 to support an upper dish basket 5 and a lower dish basket 6, respectively, but embodiments of the present disclosure are not limited thereto.

The dish baskets 7 are formed by wires arranged in a lattice pattern to allow dishes accommodated in the dish baskets 7 to be exposed outside the dish baskets 7 to be washed.

Liquid ejection units 13 and 19 to eject water to the dish baskets 7 are mounted to at least one surface of the washing tub 4. The liquid ejection units 13 and 19 may include an upper liquid ejection unit 13 and a lower liquid ejection unit 19 to eject water respectively onto an upper dish basket 5 and a lower dish basket 6, but embodiments of the present disclosure are not limited thereto.

At least one liquid ejection unit 13, 19 may be provided on at least one surface of the washing tub 4. The liquid ejection units 13 and 19 may be arranged to eject water onto the lower ends of the dish baskets 7. Deflection units 20 and 25 to deflect water ejected by the liquid ejection units 13 and 19 are provided in the washing tub 4. The deflection units 20 and 25 may be arranged to face the liquid ejection units 13 and 19. When the liquid ejection units 13 and 19 are arranged to eject water onto the lower ends of the dish baskets 7, the deflection units 20 and 25 may be positioned at the lower ends of the dish baskets 7. However, embodiments of the present disclosure are not limited thereto. The deflection units 20 and 25 may be positioned at the upper sides or lower sides of the dish baskets 7.

The dish washing machine 1 may further include a drive unit to drive the deflection units 20 and 25 to move within the washing tub 4. The drive unit may include a rail 31 coupled to the deflection units 20 and 25 and a power generating unit 35 and pulley 34 to drive the deflection units 20 and 25. The drive unit may further include a connection member 33 to connect the pulley 34 to the deflection units 20 and 25, which will be described later.

The washing tub 4 may be provided with a heater 44 and heater installation groove 45 to heat water. The heater installation groove 45 is provided at the bottom of the washing tub 4, and the heater 44 is installed at the heater installation groove 45.

The sump 43 is arranged at the center of the bottom of the washing tub 4 to collect and pump water. The sump 43 includes a wash pump 42 to pump water at high pressure, and a pump motor 41 to drive the wash pump 42. In addition, a drain pump 46 to drain water is provided at the bottom of the washing tub 4.

The wash pump 42 pumps out water toward the upper liquid ejection unit 13 through a first supply pipe 11 and pumps out water toward the lower liquid ejection unit 19 through a second supply pipe 17. While the first supply pipe 11 and the second supply pipe 17 are illustrated in FIG. 1 as being separately coupled to the sump 43, embodiments of the present disclosure are not limited thereto. That is, the first supply pipe 11 and the second supply pipe 17 may be branched off form one pipe. The first supply pipe 11 may be a connector 12, and the connector 12 may be connected to the liquid ejection unit 13.

The sump 43 may include a turbidity sensor (not shown) to detect a contamination level of water. A controller (not shown) of the dish washing machine 1 may detect the contamination level of water using a turbidity sensor (not shown), and control the number of times of performance of washing and rinsing. That is, when the contamination level is high, the number of times of performance of washing and rinsing may be increased. When the contamination level is low, the number of times of performance of washing and rinsing may be decreased.

Figure 2:
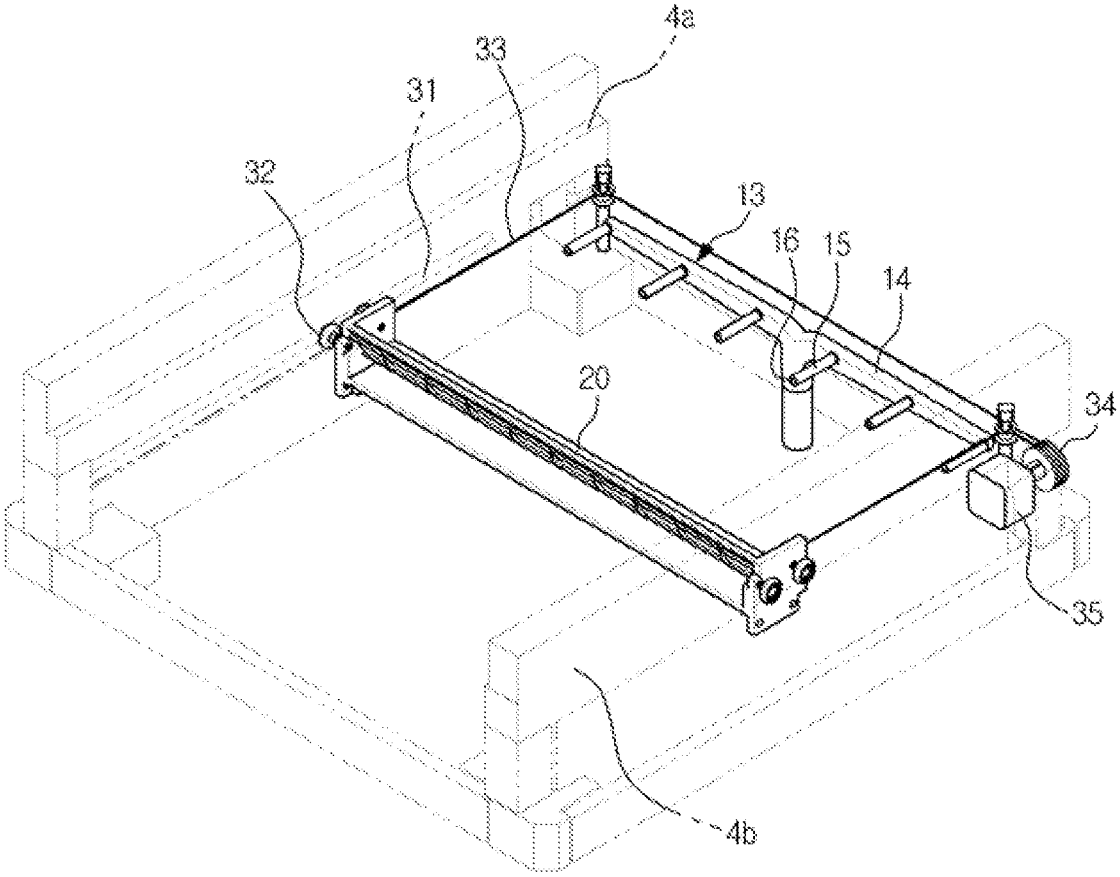
FIG. 2 is a perspective view illustrating a liquid ejection unit and a deflection unit of the dish washing machine according to the illustrated embodiment.
Figure 3:
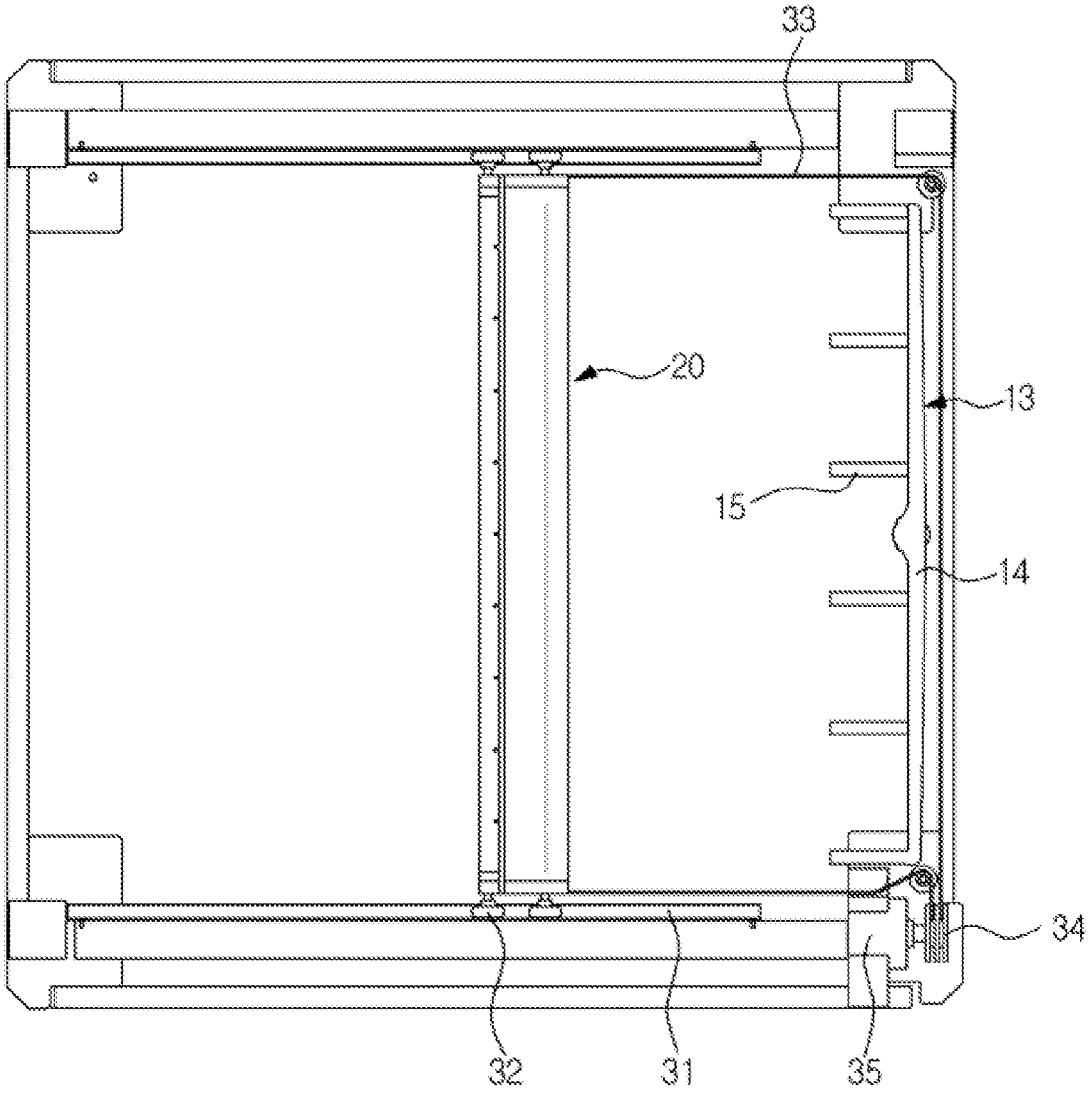
FIG. 3 is a plan view illustrating the liquid ejection unit and deflection unit of the dish washing machine according to the illustrated embodiment.

FIG. 2 is a perspective view illustrating the liquid ejection unit and deflection unit of the dish washing machine according to the illustrated embodiment, and FIG. 3 is a plan view illustrating the liquid ejection unit and deflection unit of the dish washing machine according to the illustrated embodiment.

As shown in FIGS. 2 and 3, water is ejected onto the dishes through the liquid ejection unit 13 and deflection unit 20 provided at the dish washing machine 1.

The liquid ejection unit 13 is arranged on one surface of the washing tub 4 to eject water onto the lower end of the dish basket 7. The liquid ejection unit 13 may include a body 14 coupled to the washing tub 4, and heads 15 provided with a ejection hole 16 to eject water therethrough. For example, the diameter of the ejection hole 16 may be between 5 mm and 7 mm, and six ejection holes 16 may be provided per liquid ejection unit 13. In this case, the distance from one head 15 to a neighboring head 15 may be between about 80 mm and about 90 mm.

The deflection unit 20 is provided to deflect water ejected by the liquid ejection unit 13 and arranged to face the liquid ejection unit 13. The deflection unit 20 may include a concave portion 21 (see FIG. 5). The surface of the concave portion 21 to contact water is concavely formed to deflect water to the dish basket 7. The concave portion 21 will be described later.

Rollers 32 may be provided at the opposite sides of the deflection unit 20. The deflection unit 20 may be formed of steel.

The deflection unit 20 may be coupled to the drive unit which drives the deflection unit 20 to move within the washing tub 4. The drive unit may include a rail to guide movement of the deflection unit 20. The rollers 32 of the deflection unit 20 are coupled to the rail 31 of the drive unit and are movable between the front and rear surfaces of the washing tub 4 or between left and right surfaces, along the rail 31. The rail 31 of the drive unit is coupled to both sidewalls 4*a* and 4*b* of the washing tub 4. A power generating unit 35 to drive the deflection unit 20 is coupled to the pulley 34. As an example of the power generating unit 35, a motor may be used. The pulley 34 is connected to the deflection unit 20 through the connection member 33. As the connection member 33, a braided wire or a long and thin string of a carbon material may be used. In addition to the pulley 34, other constituents such as a gear (not shown) may be provided.

When the power generating unit 35 operates, the pulley 34 may move the deflection unit 20 toward the liquid ejection unit 13 by rotating in one direction and move the deflection unit 20 away from the liquid ejection unit 13 by rotating in the opposite direction. It may be possible to operate the power generating unit 35 in the opposite manner. In addition, the deflection unit 20 may be moved away from the liquid ejection unit 13 by the pressure of water ejected by the liquid ejection unit 13. In this case, the liquid ejection unit 13 moves using the water, and therefore it may be possible to perform strong and intensive washing using the deflection unit 20 while the dishes are washed. Moreover, in the illustrated embodiment, the drive unit does not need to be directly connected to the flow channel of water, and therefore a configuration of the dish washing machine 1 simpler than that of conventional cases may be possible.

Figure 4:
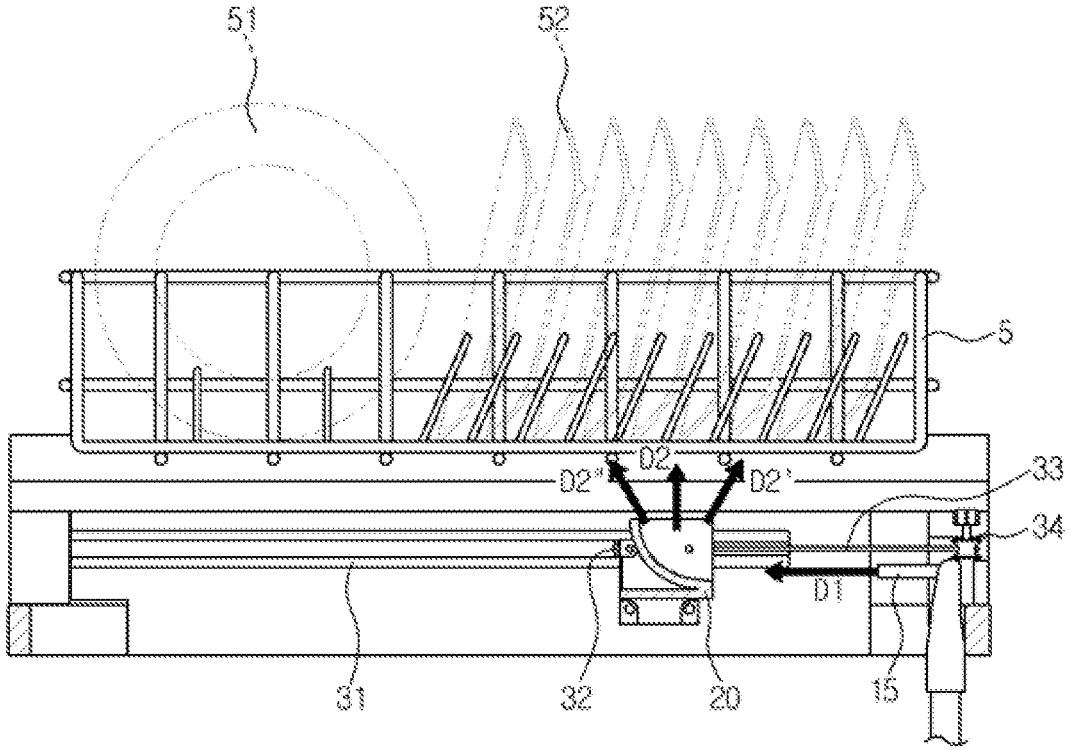
FIG. 4 is an enlarged view illustrating main constituents and directions of ejection of water in the dish washing machine according to the illustrated embodiment.

FIG. 4 is an enlarged view illustrating main constituents and directions of ejection of water in the dish washing machine according to the illustrated embodiment.

As shown in FIG. 4, water is ejected in a first direction D1 toward the dish basket 5 by the liquid ejection unit 13. That is, water is ejected in the direction parallel with the dish basket 5. The water contacts the concave portion 21 of the deflection unit 20 and is deflected in a second direction D2, D2', D2" approximately perpendicular to the dish basket 5. As the water is deflected to the direction perpendicular to the dish basket 5, the dishes 51 and 52 may be efficiently washed. Depending on the angle of the concave portion 21, the direction of the ejected water may vary. That is, the ejection of water is approximately perpendicular to the dishes 51 and 52. Referring to FIG. 4, it may be possible to eject the water in the directions D2' and D2" in addition to the direction D2. The dishes placed in the dish basket 5 may be arranged to face in various directions including the traverse direction 51 and longitudinal direction 52, and therefore the deflection unit 20 may deflect water at various angles. Washing of the dishes 51 and 52 is substantially performed by the water deflected to the second direction D2, D2', D2" by the deflection unit 20. Since the deflection unit 20 is movable forward and backward by the drive unit, strong and intensive washing of a specific area of the dishes may be performed depending on movement of the deflection unit 20.

Figure 5:
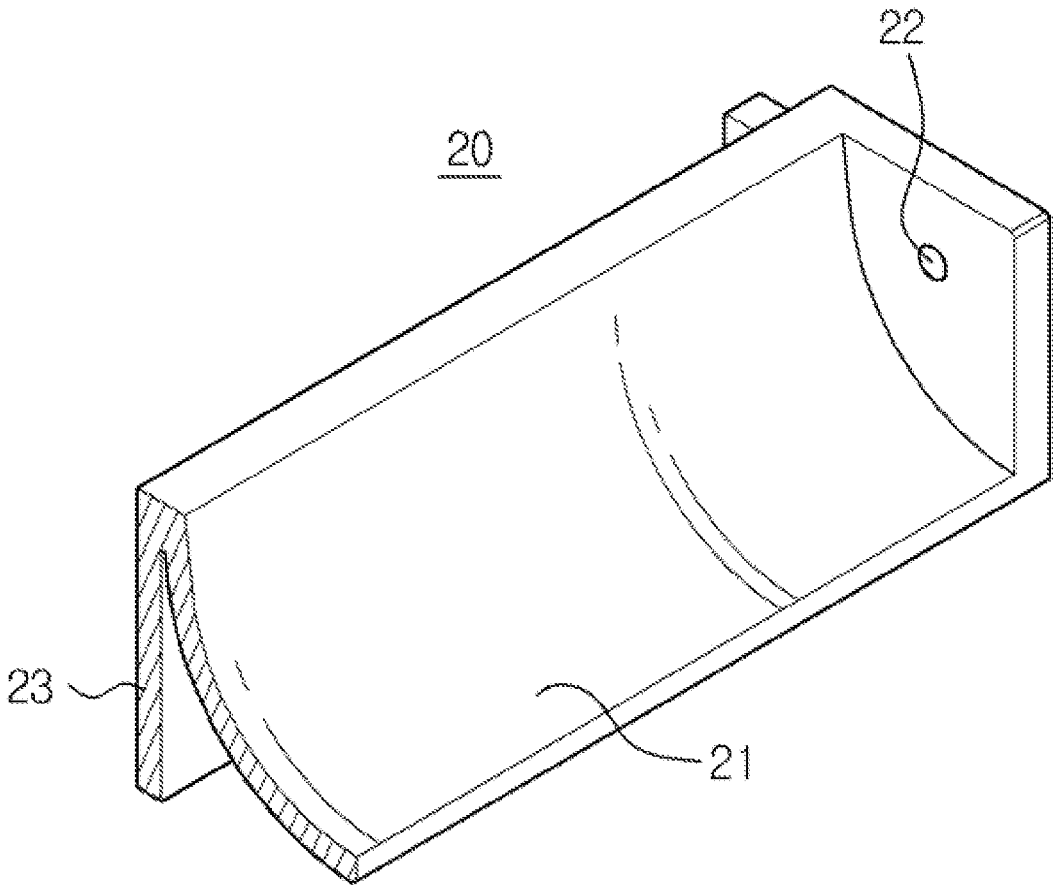
FIG. 5 is an enlarged perspective view illustrating the deflection unit of the dish washing machine according to the illustrated embodiment.

FIG. 5 is an enlarged perspective view illustrating the deflection unit of the dish washing machine according to the illustrated embodiment.

Referring to FIG. 5, the deflection unit 20 may include a concave portion 21 to deflect water. While the concave portion 21 is illustrated in FIG. 5 as being formed in the shape of a curved surface, embodiments of the present disclosure are not limited thereto.

A rear wall 23 is provided at the rear surface of the concave portion 21, while sidewalls 22 are provide at a lateral side of the concave portion 21. The rollers 32 may be coupled to the sidewalls 22. The concave portion 21 of the deflection unit 20 guides deflection of the water ejected by the liquid ejection unit 13.

The water is ejected through the ejection hole 16 of the liquid ejection unit 13 but is guided along the concave portion 21 of the deflection unit 20 and deflected to the second direction D2 to be ejected onto the dishes, and therefore the water ejected onto the dishes has a wider area than when discharged through the ejection hole 16. Accordingly, the possibility of leaving portions of the dishes unwashed may be reduced.

Figure 6:
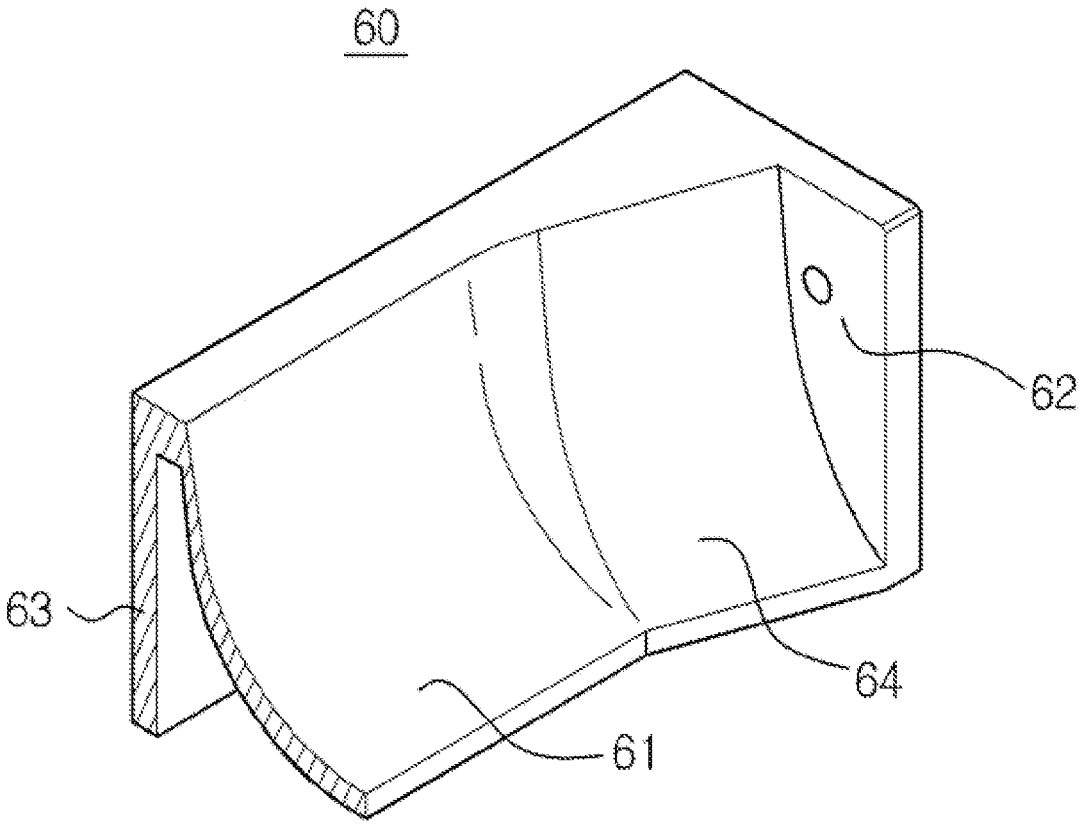
FIG. 6 is an enlarged perspective view illustrating a deflection unit of a dish washing machine according to another embodiment of the present disclosure.
Figure 7:
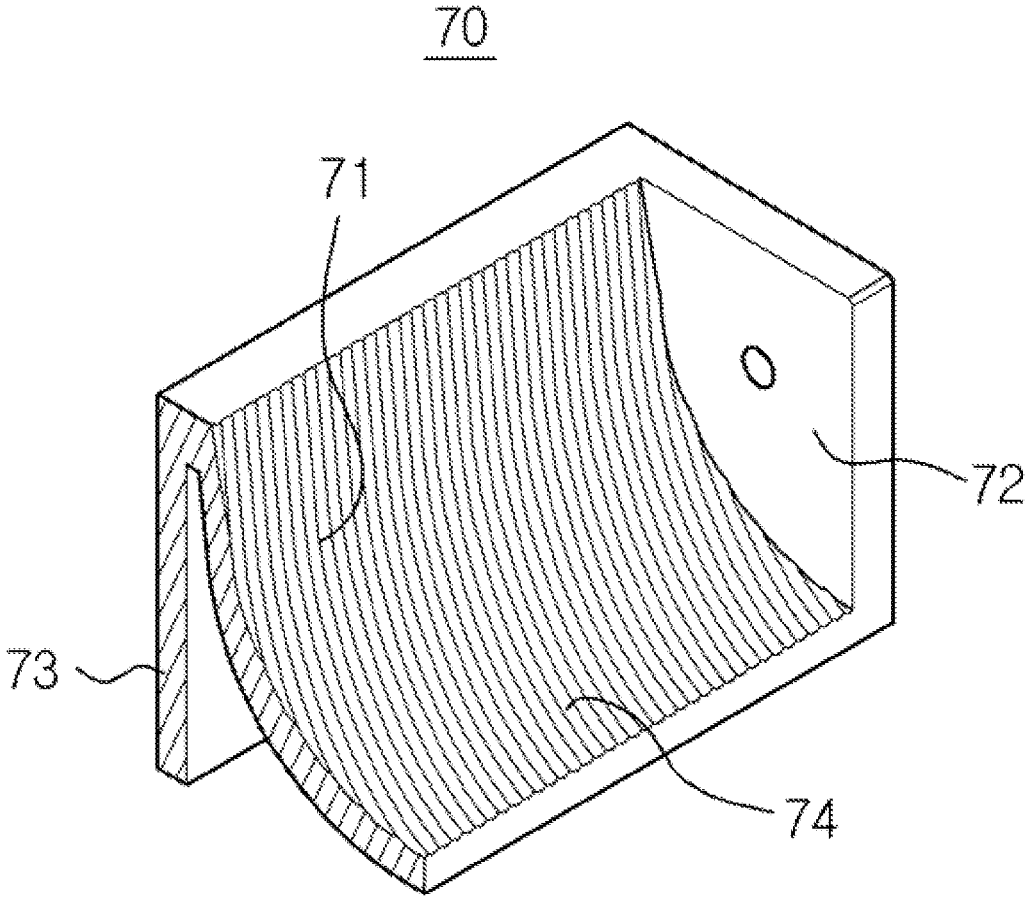
FIG. 7 is an enlarged perspective view illustrating a deflection unit of a dish washing machine according to another embodiment of the present disclosure.
Figure 8:
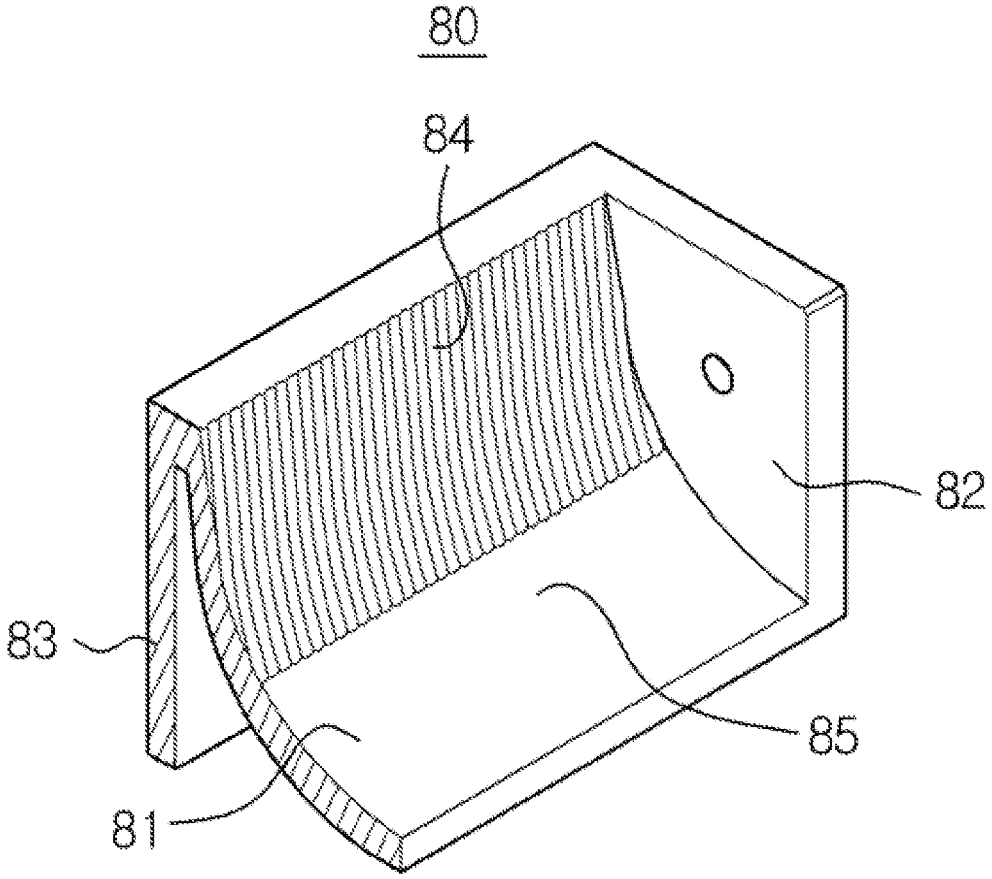
FIG. 8 is an enlarged perspective view illustrating a deflection unit of a dish washing machine according to another embodiment of the present disclosure.

FIGS. 6 to 8 are enlarged perspective views illustrating a deflection unit according to other embodiments of the present disclosure.

Referring to FIG. 6, a concave portion 61 may include at least one bent portion 64 bent along the longitudinal direction of the deflection unit 60 to deflect the ejected water in various directions. A bent portion 64 may be bent at various angles in the direction toward the concave portion 61 or the direction away from the concave portion 61. Thereby, the direction of the ejected water may be adjusted. In addition, a plurality of bent portions 64 may alternatively be provided to eject the water in various directions according to respective portions.

Referring to FIG. 7, a deflection unit 70 may be provided with a plurality of grooves 74 at the concave portion 71 to guide deflection of water. When the water contacts the grooves 74, it is deflected along the grooves 74 of the concave portion 71 toward the dishes due to water pressure. In the case that the deflection unit 70 is positioned at the lower side of the dish basket 5, the water is deflected along the concave portion 71 upward.

Referring to FIG. 8, a concave portion 81 is provided with two regions. That is, the concave portion 81 may include a first region 85 having no groove and a second region 84 having grooves formed therein. Thereby, the ejected water from the liquid ejection unit 13 is guided along the grooves in the second region 84 and deflected.

As is apparent from the above description, a dish washing machine according to an embodiment of the present disclosure includes a deflection unit in addition to a liquid ejection unit, and therefore a dead zone which water does not reach may be eliminated and divided and intensive washing may be possible in the washing tub.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A dish washing machine comprising:

a cabinet forming an external appearance of the dish washing machine;

a washing tub arranged in the cabinet and allowing dishes to be washed therein;

a dish basket arranged in the washing tub to accommodate the dishes;

a plurality of liquid ejecting heads arranged in a first direction to eject water in a second direction;

a deflection unit arranged outside of the dish basket and extending in the first direction and arranged facing the plurality of liquid ejecting heads to deflect the water ejected from the plurality of liquid ejecting heads toward the dish basket; and a drive unit to drive the deflection unit to move in the second direction within the washing tub.

2. The dish washing machine according to claim 1, wherein the drive unit is operable to move the deflection unit forward and backward in the second direction, which is perpendicular to the first direction while water is being ejected by the plurality of liquid ejecting heads.

3. The dish washing machine according to claim 1, wherein the deflection unit is disposed at at least one of upper and lower sides of the dish basket to deflect the water ejected from the plurality of liquid ejecting heads toward the dish basket.

4. The dish washing machine according to claim 1, wherein the deflection unit comprises a concave portion having a surface to contact the water ejected from the plurality of liquid ejecting heads, the surface being concavely formed to deflect the water toward the dish basket.

5. The dish washing machine according to claim 4, wherein the concave portion is formed in a shape of a curved surface to deflect the water.

6. The dish washing machine according to claim 5, wherein the concave portion comprises at least one bent portion bent along a longitudinal direction of the deflection unit to deflect the water in various directions.

7. The dish washing machine according to claim 5, wherein a plurality of grooves is provided at an inner side of the concave portion to guide deflection of the water.

8. The dish washing machine according to claim 7, wherein the grooves are formed only at a portion of the concave portion to guide deflection of the water toward the dishes.

9. The dish washing machine according to claim 1, wherein the drive unit comprises a rail coupled to the deflection unit to guide movement of the deflection unit, and a power generating unit to drive the deflection unit.

10. The dish washing machine according to claim 9, wherein the drive unit further comprises a pulley or a gear coupled to the power generating unit, and the drive unit and the deflection unit are connected to each other through a connection member.

11. The dish washing machine according to claim 9, wherein the rail is arranged at opposite walls facing each other in the washing tub to guide the movement of the deflection unit.

12. The dish washing machine according to claim 1, further comprising at least one liquid ejection unit having the plurality of liquid ejecting heads, wherein the at least one liquid ejection unit is arranged at a rear surface of the washing tub.

13. The dish washing machine according to claim 1, wherein the plurality of liquid ejecting heads are configured to eject water substantially in a horizontal direction, and the deflection unit is configured to deflect the horizontally ejected water in upward directions toward the dish basket located above the deflection unit.

14. The dish washing machine according to claim 13, wherein the deflection unit comprises an elongated plate extending parallel to the plurality of liquid ejecting heads.

15. A dish washing machine including a washing tub to wash dishes and a dish basket arranged in the washing tub to accommodate the dishes, the dish washing machine comprising:

a plurality of liquid ejecting heads arranged in a first direction to eject water in a second direction;

a deflection unit arranged outside of the dish basket and extending in the first direction arranged facing the plurality of liquid ejecting heads and moving in the second direction to deflect the water ejected from the plurality of liquid ejecting heads toward the dishes; and a drive unit to drive the deflection unit to move between front and rear surfaces of the washing tub or between left and right surfaces of the washing tub, wherein the drive unit comprises a rail coupled to the deflection unit to guide movement of the deflection unit, a motor to drive the deflection unit, a pulley or gear coupled to the motor, and a connection member to connect the pulley or gear to the deflection unit.

16. The dish washing machine according to claim 15, wherein the deflection unit comprises a concave portion concavely formed to deflect the water from the second direction toward the dishes.

17. The dish washing machine according to claim 15, wherein the deflection unit is moved toward the plurality of liquid ejection heads by the connection member and is moved away from the liquid ejection unit by a pressure of the water ejected from the liquid ejection unit.

18. A dish washing machine comprising:

a cabinet forming an external appearance of the dish washing machine;

a washing tub arranged in the cabinet and allowing dishes to be washed therein;

a plurality of liquid ejecting heads adapted to eject water in a direction substantially parallel with a dish basket;

a deflection unit arranged outside of the dish basket and arranged facing the plurality of liquid ejecting heads to contact the water ejected from the plurality of liquid ejecting heads to deflect the water in upward directions toward the dish basket located above the deflection unit; and a drive unit comprising a rail coupled to the deflection unit to allow the deflection unit to move in the direction substantially parallel with the dish basket toward or away from the plurality of liquid ejecting heads, and a motor to move the deflection unit, wherein at least one of a state in which the deflection unit is moved toward the plurality of liquid ejecting heads and a state in which the deflection unit is moved away from the plurality of liquid ejecting heads is achieved by the motor of the drive unit.

19. The dish washing machine according to claim 18, wherein the drive unit further comprises a pulley or gear coupled to the motor, and a connection member to connect the pulley or gear to the deflection unit.

20. The dish washing machine according to claim 18, wherein the deflection unit comprises an elongated plate extending parallel to the plurality of liquid ejecting heads.

* * * * *